US007757921B2

(12) United States Patent
Ishizawa et al.

(10) Patent No.: US 7,757,921 B2
(45) Date of Patent: Jul. 20, 2010

(54) DRIVING MACHINE

(75) Inventors: Yoshinori Ishizawa, Ibaraki (JP); Masashi Nishida, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 125 days.

(21) Appl. No.: 12/205,284

(22) Filed: Sep. 5, 2008

(65) Prior Publication Data

US 2009/0072002 A1 Mar. 19, 2009

(30) Foreign Application Priority Data

Sep. 7, 2007 (JP) ..... P2007-232286

(51) Int. Cl.
*B25C 7/00* (2006.01)

(52) U.S. Cl. ..... 227/119; 227/120; 227/136

(58) Field of Classification Search ..... 227/119, 227/120, 8, 136
See application file for complete search history.

(56) References Cited

U.S. PATENT DOCUMENTS 2,640,985 A * 6/1953 Bygbjerg ..... 227/120
3,708,095 A * 1/1973 Briggs, Jr. ..... 227/126
4,463,888 A * 8/1984 Geist et al. ..... 227/109
4,832,245 A * 5/1989 Terayama et al. ..... 227/130
6,622,901 B2 * 9/2003 Hamano et al. ..... 227/119
6,641,022 B2 * 11/2003 Hamano et al. ..... 227/120
7,243,831 B2 * 7/2007 Ishizawa et al. ..... 227/119
7,357,286 B2 * 4/2008 Kubo et al. ..... 227/119

FOREIGN PATENT DOCUMENTS

JP 6-297353 10/1994

* cited by examiner

*Primary Examiner*—Scott A. Smith
(74) *Attorney, Agent, or Firm*—McDermott Will & Emery LLP

(57) ABSTRACT

According to an aspect of the present invention, there is provided a driving machine including: a driver blade for striking a fastener formed into an U-shape; a nose in which a launching passage is formed; and a magazine for feeding the fastener into the launching passage, wherein the magazine has a feeder for urging the multiple fasteners toward the launching passage, and the feeder has first and second convex sections each making contact with and urging respective needle of the U-shaped fastener; the nose has a blade guide for slidably guiding the driver blade; and the blade guide has first and concave sections for accommodating the first and second convex sections, the first and second concave sections being disposed alternately in the sliding direction of the driver blade.

7 Claims, 5 Drawing Sheets

DRIVING MACHINE

CROSS-REFERENCE TO RELATED APPLICATIONS

This application is based upon and claims a priority from prior Japanese Patent Application No. 2007-32286 filed on Sep. 7, 2007, the entire contents of which are incorporated herein by reference.

BACKGROUND OF THE INVENTION

1. Field of the Invention

The present invention relates to a driving machine, more particularly, to a driving machine for driving staples having a nearly U-shape.

2. Description of the Related Art

Conventionally, a driving machine for driving staples having a nearly U-shape is known as a kind of driving machine. In this kind of driving machine, a magazine loaded with a bundle of multiple staples bonded with an adhesive or the like is mounted in the nose section thereof incorporating a sliding driver blade. A feeder for urging the bundle of staples toward the nose section is provided inside this magazine. The bundle of staples is urged using the feeder and pushed into a launching passage through which the driver blade inside the nose section passes, and the staple located at the leading end in the urging direction is driven using the driver blade.

For this kind of driving machine, various empty driving prevention apparatuses have been proposed to prevent the so-called empty driving in which the driver blade is activated and strikes the feeder after the staple at the trailing end in the urging direction has been driven. As an example of this empty driving prevention apparatus, as disclosed in JP-H06-297353-A, an apparatus is known that is provided with a switch that makes contact with the feeder and turns ON for the first time when the staple at the trailing end has been driven and the feeder has moved further in the urging direction, and the apparatus is configured such that the movement of the driver blade is restricted when this switch is ON. For the purpose of securely obtaining the movement amount of the feeder when the staple at the trailing end has been driven and the feeder has moved further in the urging direction, the apparatus is configured such that a convex section is provided at the position where the feeder makes contact with and urges the staple, such that a concave section that is engaged with the convex section is provided on the face making contact with the urged staple inside the launching passage, and such that after the staple at the trailing end has been driven, the feeder moves and the convex section is inserted into the concave section.

In the conventional driving machine, the movement amount of the feeder after the staples have been driven is obtained by virtue of the convex section of the feeder and the concave section inside the launching passage, whereby empty driving of the driver blade is prevented securely. However, since the inside of the launching passage is a place where the staple passes through and the concave section is formed in this place, there is a danger that part of the staple may be caught and the staple may jam inside the launching passage. In particular, when the staple is struck using the driver blade, a buckling stress is generated in the staple in the state that the tip ends of the staple make contact with a driven member. If the position of the end section of the staple on the side of the driver blade is coincident with the position of the concave section inside the launching passage at this time, the end section may buckle and enter the concave section, and there is a danger that improper staple driving may occur. Hence, an object of the present invention is to provide a driving machine capable of preventing jamming of fasteners to reduce improper driving.

SUMMARY OF THE INVENTION

To solve the above-mentioned problem, the present invention provides a driving machine including a driver blade for striking a fastener having two drive needle sections arranged in parallel and a connection section connecting the two drive needle sections and formed into a nearly U-shape; a nose section in which a launching passage is formed, the fastener being fed to and launched from the launching passage; and a magazine, mounted in the nose section and loaded with a bundle of multiple fasteners, for feeding the fastener located at the end section of the bundle of the fasteners into the launching passage, wherein the magazine has a feeder for urging the multiple fasteners toward the launching passage so that the fastener at the leading end in the urging direction is disposed inside the launching passage, and the feeder has a first convex section making contact with and urging one of the drive needle sections of the fastener located at the trailing end in the urging direction and a second convex section making contact with and urging the other drive needle section of the fastener; the nose section has a blade guide for slidably guiding the driver blade; and the blade guide has a first concave section for accommodating the first convex section and a second concave section for accommodating the second convex section, the first concave section and the second concave section being disposed alternately in the sliding direction of the driver blade.

With this configuration, the end sections of the fastener in the sliding direction are suppressed from entering both the first concave section and the second concave section. Hence, when the fastener is struck using the driver blade, part of the fastener is suppressed from entering the concave sections and the fastener is suppressed from bending.

In the driving machine having the above-mentioned configuration, it is preferable that the cross section of the driver blade, orthogonal to the sliding direction thereof, is formed into a convex shape and the driver blade is disposed so that the convex section having the convex shape is opposed to the blade guide; that a groove section for slidably accommodating the convex section is formed in the blade guide; and that the first concave section and the second concave section are disposed at positions communicating with the groove section.

With this configuration, the groove section and the concave sections can be formed even if the blade guide is narrow. Hence, fasteners having a small width can be used, and the driving machine can be made compact.

In addition, it is preferable that the first convex section is configured so as to include a first lower convex section disposed at the position corresponding to the tip end of one of the drive needle sections and a first upper convex section disposed at the position corresponding to the base end of the one of the drive needle sections on the side of the connection section; that the second convex section is configured so as to include a second lower convex section disposed at the position corresponding to the tip end of the other drive needle section and a second upper convex section disposed at the position corresponding to the base end of the other drive needle section on the side of the connection section; that the first concave section is configured so as to include a first lower concave section for accommodating the first lower convex section and a first upper concave section for accommodating the first upper convex section; that the second concave section is configured so as to include a second lower concave section for accommodating the second lower convex section and a second upper concave section for accommodating the second upper convex section; and that the first lower concave section and the second lower concave section are disposed alternately, and the first upper concave section and the second upper concave section are disposed alternately in the sliding direction.

With this configuration, one of the drive needle sections of the fastener can be made contact with the two convex sections and urged, whereby the bundle of the fasteners can be urged stably.

Furthermore, it is preferable that the first concave section and the second concave section are configured such that the tip end of the one of the drive needle sections of the fastener fed into the launching passage using the feeder and the tip end of the other drive needle section are disposed outside the first concave section and outside the second concave section.

Moreover, it is preferable that the first concave section and the second concave section are configured such that in the state that the fastener is struck using the driver blade and makes contact with a driven member, the connection section of the fastener is disposed outside the first concave section and outside the second concave section.

With this configuration, the tip ends of the drive needle sections and the connection section at the end sections of the fastener are further suppressed from entering the concave sections.

Still further, it is preferable that the first upper concave section and the second upper concave section are configured such that the connection section of the fastener fed into the launching passage using the feeder is disposed outside the first upper concave section and outside the second upper concave section.

With this configuration, the connection section at the end section of the fastener is further suppressed from entering the concave sections.

Yet still further, it is preferable that the feeder is provided with a guide face, extending in the sliding direction, for guiding the last fastener of the multiple fasteners formed into a bundle to the inside of the launching passage.

With this configuration, when the last fastener of the bundle of fasteners is driven, the last fastener can be guided into the launching passage securely.

With the driving machine according to the present invention, jamming of fasteners is prevented, and improper driving can be reduced.

BRIEF DESCRIPTION OF THE DRAWINGS

Embodiments of the present invention will be described in detail based on the following figures, wherein.

DETAILED DESCRIPTION OF THE INVENTION

Figure 1:
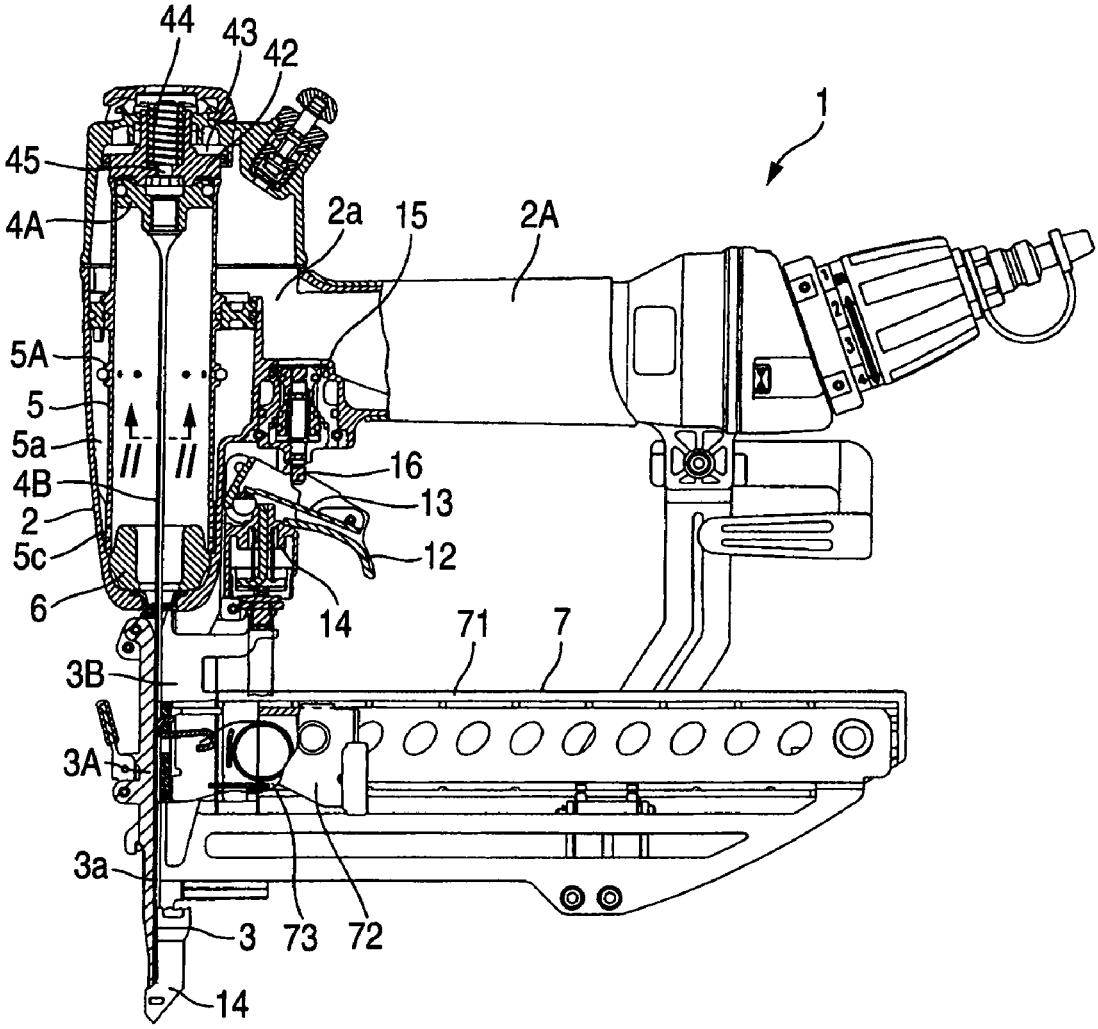
FIG. 1 is a sectional view showing a nail driving machine according to an embodiment of the present invention.

A driving machine according to an embodiment of the present invention will be described below on the basis of FIGS. 1 to 6. The nail driving machine 1 shown in FIG. 1, serving as a driving machine, is a tool for driving staples 10 used as fasteners, and uses compressed air as its source of power. As shown in FIG. 4, the staple 10 has two drive needle sections 10A and 10A arranged in parallel and a connection section 10B connecting the two drive needle sections and is formed into a nearly U-shape. The staple 10 is configured such that the distance between the two drive needle sections 10A and 10A is approximately 3.85 mm and such that the length of each of the two drive needle sections 10A and 10A is a predetermined length of 25 to 50 mm.

The nail driving machine 1 integrally includes a frame 2, a handle 2A positioned on one side of the frame 2 and a nose section 3 positioned at the lower end of the frame 2. An accumulator 2*a* is formed inside the handle 2A and the frame 2 of the nail driving machine 1 to accumulate compressed air supplied from a compressor, not shown. The accumulator 2*a* is connected to the compressor, not shown, via an air hose, not shown.

Figure 2:
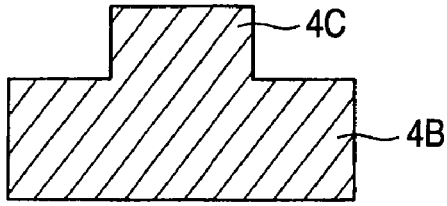
FIG. 2 is a sectional view taken on line II-II of FIG. 1.

A cylinder 5 having a cylindrical shape is provided inside the frame 2, a piston 4A is provided inside the cylinder 5 so as to be slidable up and down, and a driver blade 4B is integrated with the piston 4A. The direction in which this driver blade 4B moves together with the piston 4A is defined as its sliding direction, and the side of the nose section 3 with respect to the frame 2 is defined as the lower side (the opposite side is defined as the upper side). In addition, as shown in FIG. 2, the cross section of the driver blade 4B is formed into a convex shape, and the driver blade 4B is disposed such that the protruding section having this convex shape is positioned on the opposite side of a magazine 71 described later.

A return chamber 5*a* for accumulating compressed air for returning the driver blade 4B to its top dead center is provided on the outer circumference of the lower end of the cylinder 5. A check valve 5A is provided at the central section of the cylinder 5 in the axial direction thereof, an air passage for allowing air to flow only in one direction from inside the cylinder 5 to the return chamber 5*a* outside the cylinder 5 is formed in the check valve 5A, and an air passage 5*c* being open to the return chamber 5*a* at all times is formed below the cylinder 5. In addition, a piston bumper 6 for absorbing the surplus energy of the piston 4A after the staple 10 has been driven is provided at the lower end of the cylinder 5.

A trigger 12 operated by the worker, an arm plate 13 rotatably mounted on the trigger 12, a push lever 14 protruding from the lower end of the nose section 3, extending to the vicinity of the arm plate 13 and urged from the frame 2 toward the nose section 3 so as to be movable along the nose section 3, a trigger valve section 15 serving as a change-over valve and communicating with a main valve 42 described later so as to supply and exhaust compressed air, a plunger 16 for transmitting the action of the arm plate 13 to the trigger valve section 15, etc. are provided at the base section of the handle 2A.

As is generally known, when both the pulling operation of the trigger 12 and the pushing operation of the push lever 14 toward a driven member, not shown, are carried out, the plunger 16 of the trigger valve section 15 is raised using the link mechanism of the arm plate 13 and the trigger 12. Furthermore, the push lever 14 is configured so as to be engageable with a feeder engaging section described later, not shown, and so as not to be movable up and down in the state that the push lever 14 is engaged with the feeder engaging section.

The main valve 42, a main valve chamber 43 for accommodating the main valve 42, a main valve spring 44 for urging the main valve 42 toward its bottom dead center, etc. are provided on the upper outer circumference of the cylinder 5. In addition, an air passage 45 is formed in the main valve 42 so as to be able to communicate with ambient air via an exhaust port, not shown, provided in the upper section of the frame 2.

The nose section 3 includes a blade guide 3A positioned at the lower end of the frame 2 and extending in a direction in parallel with the sliding direction of the driver blade 4B and a nose frame 3B connected to the frame 2. In addition, a launching passage 3*a*, in which one face of the blade guide 3A is used as part of its inner face with which the staple 10 makes contact and the nose frame 3B is used as its face for guiding the side sections (the two drive needle sections 10A and 10A) of the staple 10, is formed in the nose section 3. Furthermore, in the nose section 3, a magazine apparatus 7, loaded with multiple staples 10 connected and formed into a bundle, for feeding the staples 10 into the launching passage 3*a* is connected to the nose frame 3B, and the feeder engaging section, not shown, for restricting the action of the push lever 14 when the staples 10 inside the magazine apparatus 7 have been consumed is provided.

Figure 3:
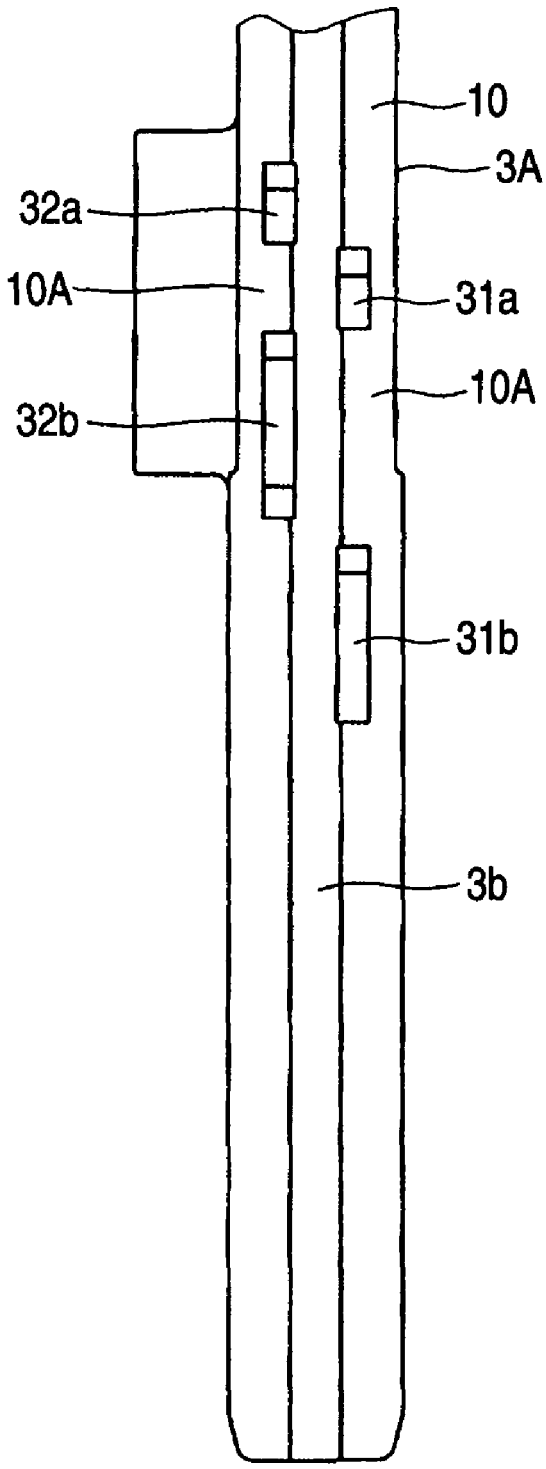
FIG. 3 is a plan view showing the blade guide of the nail driving machine according to the embodiment of the present invention.
Figure 4:
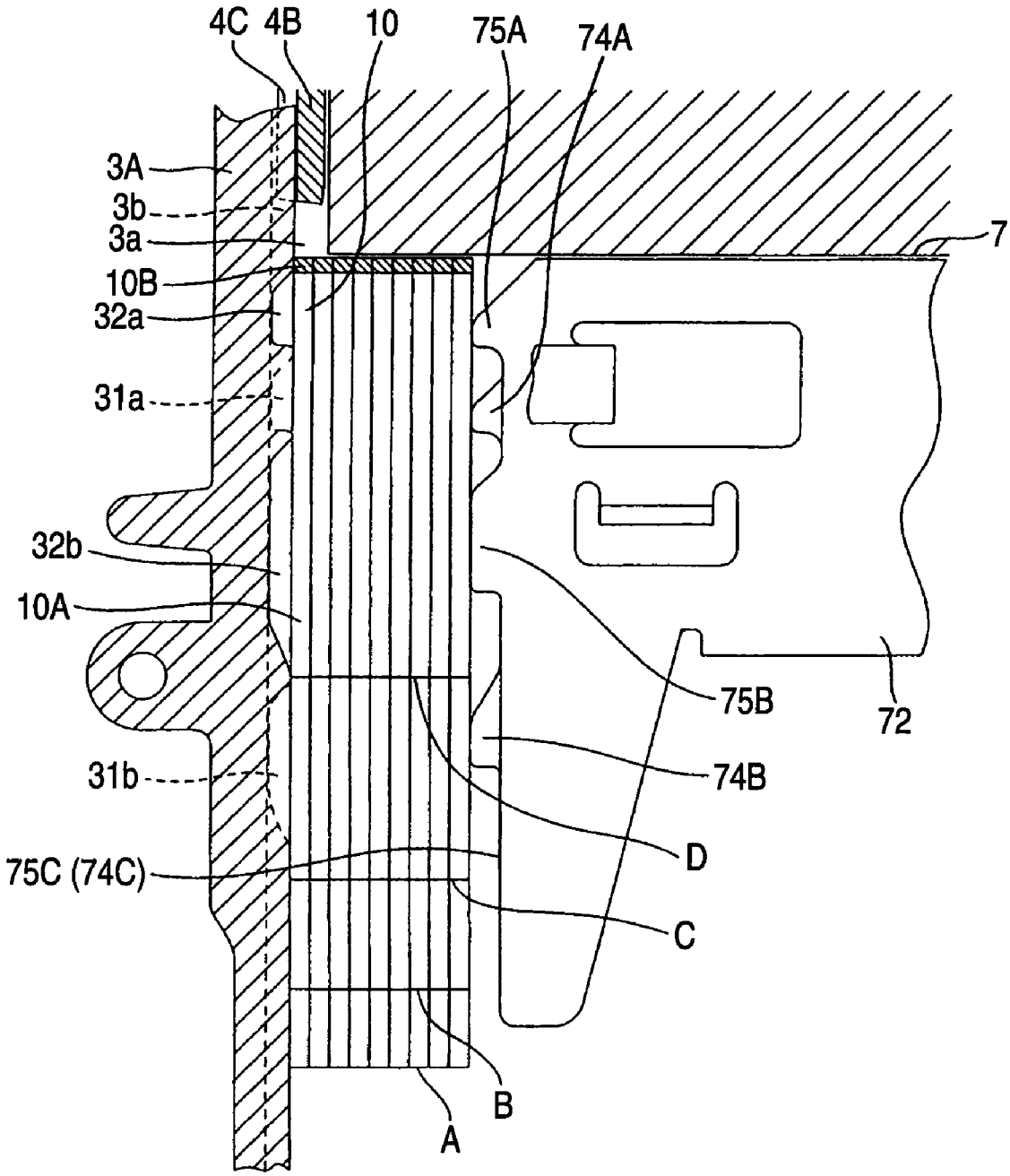
FIG. 4 is a detailed sectional view showing the vicinity of the nose section of the nail driving machine according to the embodiment of the present invention.

The blade guide 3A is formed separate from the frame 2 and mounted on the nose frame 3B, and a groove section 3*b* for slidably accommodating the projecting section of the driver blade 4B is formed in the sliding direction as shown in FIG. 3. In addition, in the blade guide 3A, a first upper concave section 31*a* and a first lower concave section 31*b* are formed so as to be arranged up and down on the upper right side of the groove section 3*b* on the paper face of FIG. 3, and a second upper concave section 32*a* and a second lower concave section 32*b* are formed so as to be arranged up and down on the upper left side of the groove section 3*b* on the paper face of FIG. 3.

The first upper concave section 31*a*, the first lower concave section 31*b*, the second upper concave section 32*a* and the second lower concave section 32*b* are respectively formed so as to communicate with the groove section 3*b*. The first upper concave section 31*a* and the second upper concave section 32*a* are disposed alternately in the sliding direction, and the first lower concave section 31*b* and the second lower concave section 32*b* are also disposed alternately in the sliding direction.

As shown in FIG. 4, the first upper concave section 31*a* and the second upper concave section 32*a* are formed in the blade guide 3A so that the connection section 10B of the staple 10 fed from the magazine apparatus 7 is not positioned inside these concave sections 31*a* and 32*a*, and the first lower concave section 31*b* and the second lower concave section 32*b* are formed in the blade guide 3A so that the tip end sections of the drive needle sections 10A of the staple 10 fed from the magazine apparatus 7 are not positioned inside these concave sections 31*b* and 32*b* simultaneously. In particular, the first lower concave section 31*b* and the second lower concave section 32*b* are formed so that the tip end sections of the staple 10 are not positioned inside the concave sections, regardless of whether the staple 10 has a predetermined length of A (50 mm), B (38 mm), C (32 mm) or D (25 mm).

Figure 6:
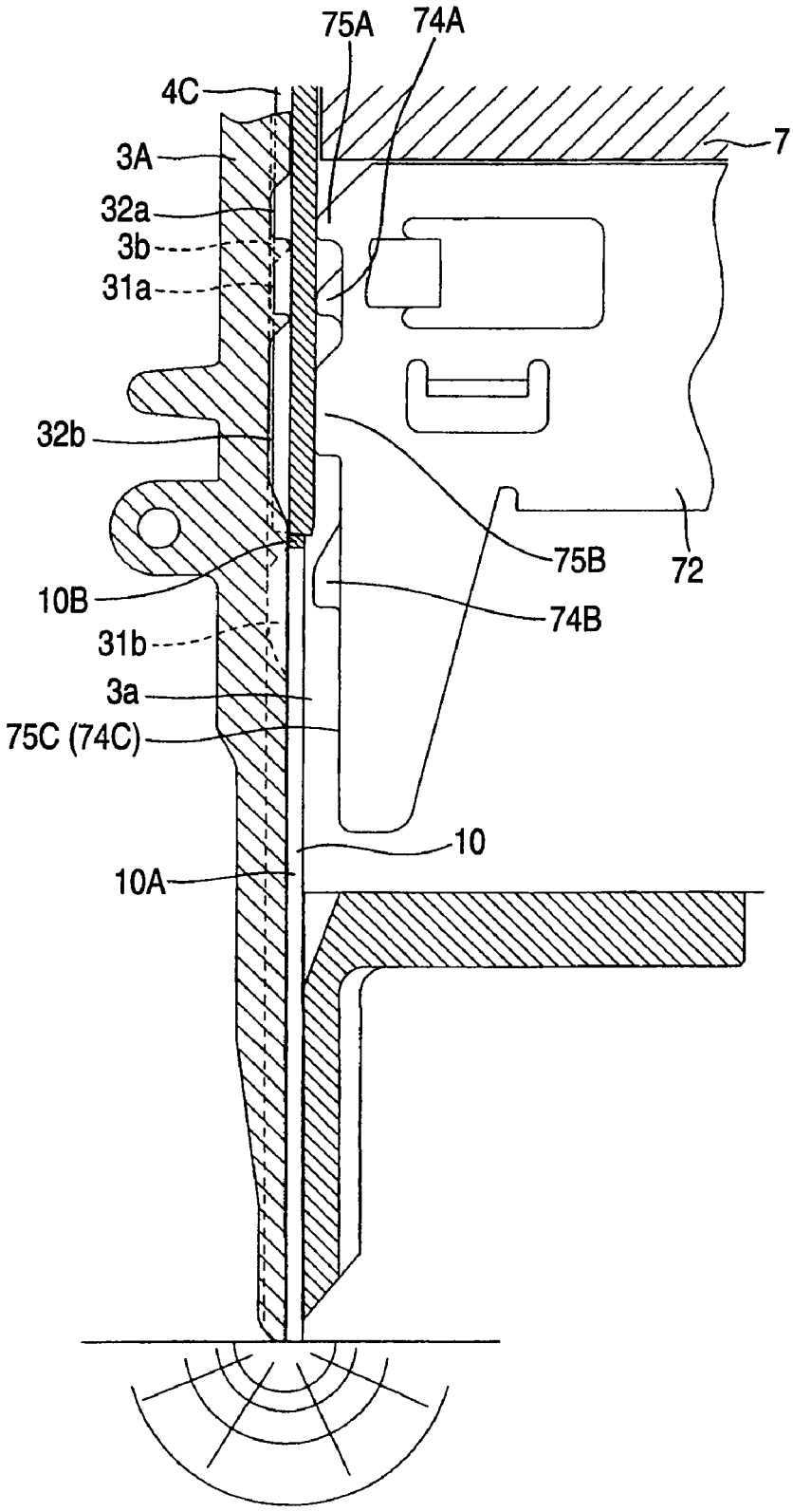
FIG. 6 is a detailed sectional view showing the vicinity of the nose section in the state that the last staple remaining in the nail driving machine according to the embodiment of the present invention is struck and made contact with a driven member.

Furthermore, the first concave section and the second concave section, more particularly, the first lower concave section 31*b* and the second lower concave section 32*b*, are configured such that the connection section 10B is disposed outside the first lower concave section 31*b* and outside the second lower concave section 32*b* in the state that the staple 10 having the above-mentioned predetermined length is struck using the driver blade 4B and makes contact with a driven member as shown in FIG. 6.

With these configurations, when the staple 10 is driven by striking using the driver blade 4B, the staple 10 is suppressed from buckling, and the connection section 10B and the tip end sections of the drive needle sections 10A are suppressed from entering the connection sections 31*b* and 32*b* and from bending.

Furthermore, since the first upper concave section 31*a*, the first lower concave section 31*b*, the second upper concave section 32*a* and the second lower concave section 32*b* respectively communicate with the groove section 3*b*, the distance between the first concave section including the first upper concave section 31*a* and the first lower concave section 31*b* and the second concave section including the second upper concave section 32*a* and the second lower concave section 32*b* can be made shorter. Hence, the first concave section and the second concave section correspond to the positions of the two drive needle sections 10A and 10A of the staple 10, whereby the width in a direction orthogonal to the sliding direction of the blade guide 3A (the direction in which the two drive needle sections 10A and 10A of the staple 10 are arranged in parallel) can be made smaller.

The magazine apparatus 7 mainly includes the magazine 71 and a feeder 72. The magazine 71 is provided near the blade guide 3A, disposed in nearly parallel with the extending direction of the handle 2A and loaded with a bundle of the staples 10 therein.

Figure 5:
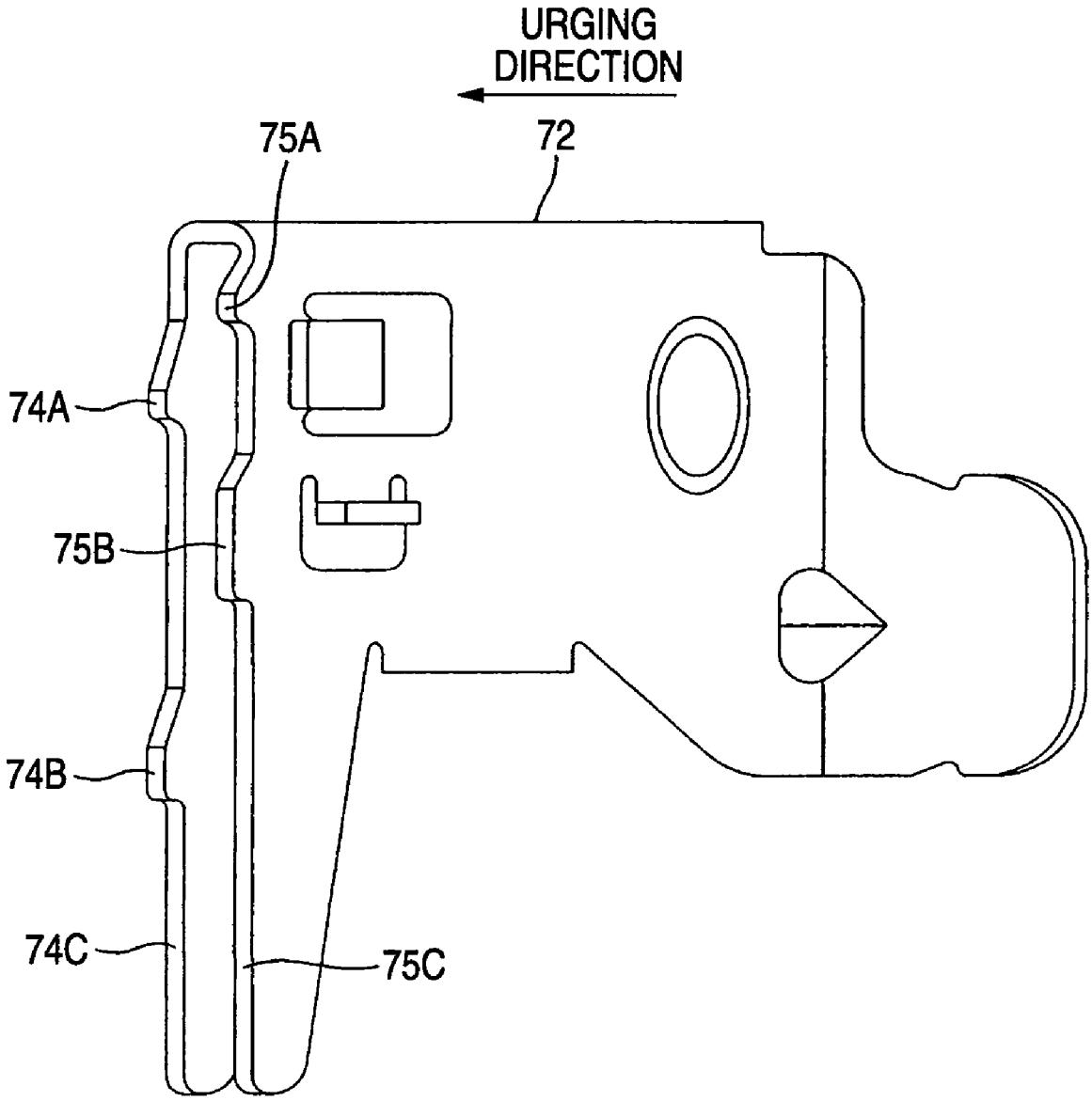
FIG. 5 is a perspective view showing the feeder of the nail driving machine according to the embodiment of the present invention.

The feeder 72 is incorporated inside the magazine 71 and has a spring 73 to urge the staples 10 toward the inside of the launching passage 3*a* by the urging force of the spring 73. The cross section of the feeder 72, orthogonal to the urging direction of the feeder 72, is formed into a nearly U-shape as shown in FIG. 5. A first upper convex section 74A, a first lower convex section 74B, a second upper convex section 75A and a second lower convex section 75B, making contact with the trailing end of the bundle of the staples 10 in the urging direction, are provided at the end face section of the feeder 72 in the urging direction serving as the arm section having a nearly U-shape, and these convex sections are disposed at positions corresponding to the first upper concave section 31*a*, the first lower concave section 31*b*, the second upper concave section 32*a* and the second lower concave section 32*b*, respectively. Since the first upper convex section 74A and the first lower convex section 74B make contact with one of the two drive needle sections 10A and 10A of the staple 10 and the second upper convex section 75A and the second lower convex section 75B make contact with the other drive needle section 10A, the bundle of the staples 10 can be urged stably.

Furthermore, on the above-mentioned end face of the feeder 72, a first guide face 74C and a second guide face 75C are defined on the lower sides of the first lower convex section 74B and the second lower convex section 75B, respectively. In the state that the last staple 10 remains as shown in FIG. 6, no staple exists adjacent to the staple 10 to be struck. Hence, there is a danger that the staple 10 to be struck may bend toward the feeder 72. However, since the first guide face 74C and the second guide face 75C are provided, the last staple 10 is suppressed from bending excessively and can be driven properly.

Moreover, the feeder 72 is provided with the feeder engaging section, not shown, that is engaged with the push lever 14 to restrict the action of the push lever 14 only in the state that the above-mentioned four convex sections 74A, 74B, 75A and 75B are engaged with the four concave sections 31*a*, 31*b*, 32*a* and 32*b* respectively corresponding thereto, that is, only in the state that the feeder 72 is located closest to the blade guide 3A.

When the staple 10 is struck using the nail driving machine 1 having the above-mentioned configuration, since the connection section 10B and the drive needle sections 10A of the staple 10 are suppressed from entering the concave sections 31*a*, 31*b*, 32*a* and 32*b* of the blade guide 3A as described above, the staple 10 can be struck properly without clogging the launching passage 3*a*. Even in the state that the last staple 10 remains, since the staple 10 is guided using the first guide face 74C and the second guide face 75C, the staple 10 is suppressed from bending.

Still further, since no staple 10 exists inside the magazine apparatus 7 after all the staples 10 have been struck, the convex sections of the feeder 72 are inserted into the concave sections of the blade guide 3A and engaged therewith, respectively. In the state that the staples 10 are stored inside of the magazine apparatus 7, the staples 10 are struck one by one and consumed. Hence, the movement distance of the feeder 72 approaching the blade guide 3A is equal to the thickness of the staple 10. However, after the last staple 10 has been struck, since the convex sections of the feeder 72 are inserted into the concave sections of the blade guide 3A, respectively, the movement distance of the feeder 72 is larger. Hence, the feeder engaging section, not shown, is not engaged with the push lever 14 in the state that the last staple 10 remains. The feeder engaging section, not shown, can be engaged with the push lever 14 for the first time in the state that all the staples 10 have been struck and the feeder 72 has moved the larger distance.

Compressed air is used as the source of power in the nail driving machine 1 according to this embodiment. However, without being limited to this, an electric motor may also be used as the source of power, or the explosion power of a combustible material, such as gas, may also be used as the source of power. The present invention is applicable to any nail driving machine that uses a driver blade to strike staples, regardless of its source of power.

What is claimed is:

1. A driving machine comprising:

a driver blade for striking a fastener having two drive needle sections arranged in parallel and a connection section connecting the two drive needle sections and formed into a nearly U-shape;

a nose section in which a launching passage is formed, the fastener being fed to and launched from the launching passage; and a magazine, mounted in the nose section and loaded with a bundle of multiple fasteners, for feeding the fastener located at the end section of the bundle of the fasteners into the launching passage, wherein the magazine has a feeder for urging the multiple fasteners toward the launching passage so that the fastener at the leading end in the urging direction is disposed inside the launching passage, and the feeder has a first convex section making contact with and urging one of the drive needle sections of the fastener located at the trailing end in the urging direction and a second convex section making contact with and urging the other drive needle section of the fastener;

the nose section has a blade guide for slidably guiding the driver blade; and the blade guide has a first concave section for accommodating the first convex section and a second concave section for accommodating the second convex section, the first concave section and the second concave section being disposed alternately in the sliding direction of the driver blade.

2. The driving machine according to claim 1, wherein the cross section of the driver blade, orthogonal to the sliding direction thereof, is formed into a convex shape and the driver blade is disposed so that the convex section having the convex shape is opposed to the blade guide;

a groove section for slidably accommodating the convex section is formed in the blade guide; and the first concave section and the second concave section are disposed at positions communicating with the groove section.

3. The driving machine according to claim 2, wherein the first convex section is configured so as to include a first lower convex section disposed at the position corresponding to the tip end of one of the drive needle sections and a first upper convex section disposed at the position corresponding to the base end of the one of the drive needle sections on the side of the connection section;

the second convex section is configured so as to include a second lower convex section disposed at the position corresponding to the tip end of the other drive needle section and a second upper convex section disposed at the position corresponding to the base end of the other drive needle section on the side of the connection section;

the first concave section is configured so as to include a first lower concave section for accommodating the first lower convex section and a first upper concave section for accommodating the first upper convex section; and the second concave section is configured so as to include a second lower concave section for accommodating the second lower convex section and a second upper concave section for accommodating the second upper convex section; and the first lower concave section the second lower concave section are disposed alternately, and the first upper concave section and the second upper concave section are disposed alternately in the sliding direction.

4. The driving machine according to claim 2, wherein the first upper concave section and the second upper concave section are configured such that the connection section of the fastener fed into the launching passage using the feeder is disposed outside the first upper concave section and outside the second upper concave section.

5. The driving machine according to claim 1, wherein the first concave section and the second concave section are configured such that the tip end of the one of the drive needle sections of the fastener fed into the launching passage using the feeder and the tip end of the other drive needle section are disposed outside the first concave section and outside the second concave section.

6. The driving machine according to claim 1, wherein the first concave section and the second concave section are configured such that in the state that the fastener is struck using the driver blade and makes contact with a driven member, the connection section of the fastener is disposed outside the first concave section and outside the second concave section.

7. The driving machine according to claim 1, wherein the feeder is provided with a guide face, extending in the sliding direction, for guiding the last fastener of the multiple fasteners formed into a bundle to the inside of the launching passage.

* * * * *